US007574809B2

(12) United States Patent
Follo et al.

(10) Patent No.: US 7,574,809 B2
(45) Date of Patent: Aug. 18, 2009

(54) SHAVING IMPLEMENT HAVING A CAP FORWARD PIVOT

(75) Inventors: Thomas A. Follo, Milford, CT (US); Paul D. Richard, Shelton, CT (US); John F. Pacilio, West Haven, CT (US)

(73) Assignee: Everready Bateery Company, Inc., St. Louis, MO (US)

( * ) Notice: Subject to any disclaimer, the term of this patent is extended or adjusted under 35 U.S.C. 154(b) by 216 days.

(21) Appl. No.: 11/455,975

(22) Filed: Jun. 19, 2006

(65) Prior Publication Data

US 2006/0283025 A1 Dec. 21, 2006

Related U.S. Application Data

(60) Provisional application No. 60/692,498, filed on Jun. 20, 2005.

(51) Int. Cl.
*B26B 21/52* (2006.01)

(52) U.S. Cl. ..... 30/527; 30/50

(58) Field of Classification Search ..... 30/50, 30/527, 530, 532, 533
See application file for complete search history.

(56) References Cited

U.S. PATENT DOCUMENTS

| | | | | |
|---|---|---|---|---|
| 4,275,498 | A * | 6/1981 | Ciaffone | 30/47 |
| 4,281,456 | A * | 8/1981 | Douglass et al. | 30/527 |
| 4,970,784 | A * | 11/1990 | Althaus et al. | 30/527 |
| 5,813,119 | A | 9/1998 | Ferraro | |
| 6,311,400 | B1 * | 11/2001 | Hawes et al. | 30/527 |
| 6,557,265 | B2 * | 5/2003 | Coffin | 30/532 |
| 6,612,040 | B2 * | 9/2003 | Gilder | 30/530 |
| 6,615,498 | B1 | 9/2003 | King | |
| 6,807,739 | B2 | 10/2004 | Follo | |
| 2002/0116822 | A1 | 8/2002 | Coffin | |
| 2002/0116832 | A1 | 8/2002 | Coffin | |
| 2003/0217472 | A1 | 11/2003 | Follo | |
| 2004/0181953 | A1 | 9/2004 | Follo et al. | |
| 2005/0034314 | A1 | 2/2005 | Cuisinier | |
| 2007/0137045 | A1 * | 6/2007 | Follo et al. | 30/50 |

FOREIGN PATENT DOCUMENTS

| | | |
|---|---|---|
| EP | 1136197 | 9/2001 |
| WO | WO 2007/002055 A1 * | 1/2007 |

OTHER PUBLICATIONS

International Search Report for PCT/US2006/023932, Nov. 8, 2006.

* cited by examiner

*Primary Examiner*—Hwei-Siu C Payer
(74) *Attorney, Agent, or Firm*—Energizer Personal Care, LLC

(57) ABSTRACT

A shaving implement includes a handle; a razor cartridge pivotally connected thereto; a biasing member extending from the handle and contacting the razor cartridge; and a bridge pivotally connected to the razor cartridge and slidably connected to the handle. The razor cartridge includes one or more razor blades and a cap located aft of the blades. The razor cartridge is pivotally connected to the handle such that the cartridge pivots about an axis that is generally parallel to and aft of the razor blades, the cartridge being pivotable between a neutral position and a rotated position. The biasing member extending from the handle is in contact with the razor cartridge to urge the cartridge toward the neutral position. The bridge is slidable between a first position when the razor cartridge is in the neutral position and a second position when the cartridge is in the rotated position.

16 Claims, 5 Drawing Sheets

SHAVING IMPLEMENT HAVING A CAP FORWARD PIVOT

TECHNICAL FIELD

The present disclosure relates to shaving implements in general and, more particularly, to shaving implements having razor cartridges in which the razor cartridges pivot about axes located below the caps of the razor cartridges.

BACKGROUND OF THE INVENTION

Shaving implements, typically those known as wet shave razors, generally each include a razor cartridge and a handle. The razor cartridge includes at least one razor blade mounted therein aft of a guard and forward of a cap such that cutting edges of the razor blade are at or proximate a shave plane defined as a theoretical plane extending tangentially from the uppermost portions of the guard and the cap. The razor cartridge is pivotally mounted on the handle such that during use the razor cartridge is able to pivot relative to the handle between a neutral position and a rotated position. The pivoting action of the razor cartridge between the neutral and rotated positions relative to the handle enables the razor blades to maintain contact with the surface being shaved despite elevations and depressions in the surface.

In most wet shave razors, the axis about which the razor cartridge pivots is located in the area of the guard. In these types of razors, the razor cartridge tends to pivot erratically when used in an effort to precisely control movement for trimming intricate details in a hirsute surface. One cause of the erratic movement is the exertion of minute and unintentional forces on the handle. Another cause is generally due to frictional forces caused by the surface being shaved passing over the guard bar. Still another cause may be that forces encountered during the cutting of the hair tend to urge the razor cartridge to the rotated position.

As described above, the razor cartridge is pivotal about an axis located in the area of the guard. That axis is also located either above or below the shave plane and adjacent and forward of the razor blades. Biasing members may be used to limit the unintentional pivotal movement of the razor cartridge, but they are typically subject to a multitude of interacting factors, for example, how hard the user presses the razor cartridge against his or her skin, the amount of hair being removed, and the amount of water and/or shaving aid present. The problem is exacerbated when the user is shaving or trimming intricate details. In these instances, the user typically presses the razor against the surface being shaved with a force greater than normal, and tends to move the razor slowly, as he or she shaves intricate details. Consequently, the razor cartridge, experiencing greater forces on the guard and the razor blades, tends to rotate away from the surface being shaved, thereby causing the razor blades to lose contact. The result is that, even with precise attention and the presence of a guard bar, the desired shave is not achieved because the razor blades are not in the intended position (in contact with the surface being shaved).

What is needed is a shaving implement that overcomes the problems and drawbacks associated with the prior art.

SUMMARY OF THE INVENTION

In one aspect, the present invention is directed to a shaving implement usable in a wet shaving operation. The shaving implement includes a handle; a razor cartridge pivotally connected to the handle; a biasing member extending from the handle and in contact with the razor cartridge; and a bridge pivotally connected to the razor cartridge and slidably connected to the handle. The razor cartridge includes one or more razor blades and a cap located aft of the razor blades. The razor cartridge is pivotally connected to the handle such that the razor cartridge pivots about an axis that is generally parallel to and aft of the razor blades, the razor cartridge being pivotable between a neutral position and a rotated position. The biasing member extending from the handle is in contact with the razor cartridge to urge the razor cartridge toward the neutral position. The bridge is slidable between a first position when the razor cartridge is in the neutral position and a second position when the razor cartridge is in the rotated position.

In another aspect, the present invention is directed to a razor head for a shaving implement usable in a wet shaving operation. The razor head includes a support portion; a support arm extending from the support portion; a razor cartridge pivotally connected to the support arm and pivotable between a neutral position and a rotated position; a biasing member in contact with the razor cartridge to urge the razor cartridge toward the neutral position; and a bridge pivotally connected to the razor cartridge and slidably connected to the support portion. The razor cartridge includes at least one razor blade and a cap located aft of the at least one razor blade. The bridge is slidable between a first position when the razor cartridge is in the neutral position and a second position when the cartridge is in the rotated position.

In still another aspect, the present invention is directed to a razor head having a support portion; a support arm extending from the support portion; a razor cartridge pivotally connected to the support arm and pivotable between a neutral position and a rotated position; a biasing member in contact with the razor cartridge to urge the razor cartridge toward the neutral position; and a bridge connected to the razor cartridge and connected to the support portion. As in the other embodiments, the razor cartridge includes at least one razor blade and a cap located aft of the razor blade. The bridge allows the razor cartridge to be maintained in the neutral position when the razor cartridge is not subjected to a shaving force and allows the razor cartridge to be maintained in the rotated position when the razor cartridge is subjected to the shaving force. The connection of the bridge to the razor cartridge is a flexible connection.

The embodiments of the present invention, as described herein, allow for improved control while shaving and trimming areas that require fine detailing. In particular, by moving the pivot axis about which the razor cartridge rotates relative to the handle to a more desirable location (under the cap), improved control of the shaving implement can be maintained during a shaving operation, thereby improving the quality of the resulting shave.

Another advantage of the present invention is that the forces that act on the razor cartridge that occur during normal shaving that tend to cause the razor cartridge to pivot relative to the handle are reduced. The biasing member, in conjunction with the connection of the razor cartridge to the handle via the bridge, allows erratic forces to be buffered, which facilitates the steady positioning of the razor cartridge relative to the surface being shaved.

Still another advantage of the present invention is that the flexibility of the supporting arms at which the razor cartridge is mounted provide shock absorbing qualities to the shaving implements during a shaving operation. The degree of flexibility of the supporting arms effectively eliminates or reduces the amount of chatter (uncontrolled rapid alternation between two positions) experienced by the razor blades during the shaving operation.

DETAILED DESCRIPTION OF THE INVENTION

Figure 1:
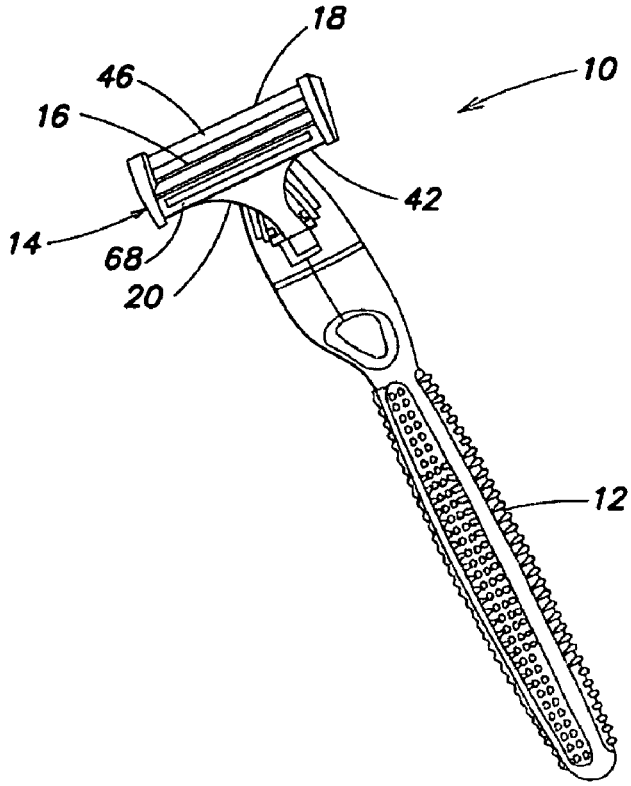
FIG. 1 is a perspective view of a shaving implement of the present invention.

Referring to FIG. 1, a shaving implement of the present invention is depicted generally by the reference numeral 10. The shaving implement 10 (which may be a wet shaving razor) includes a handle 12 and a razor cartridge 14 pivotally attached to the handle. The razor cartridge 14 includes at least one razor blade 16 (two are shown) and a cap 18 positioned aft of the razor blades. A bridge 20 is pivotally connected to a forward portion of the razor cartridge 14 in front of the razor blades 16 and extends to the handle 12. A portion of the bridge 20 adjacent the pivotal connection of the bridge to the razor cartridge 14 defines a guard 42.

The cap 18 may include an attached comfort strip 46 (also known as a lubricating strip), which may include a shaving aid. For example, the shaving aid may include one or more of the following:

A. A lubricating agent for reducing the frictional forces between the razor and the skin, e.g., a micro-encapsulated silicone oil.

B. An agent which reduces the drag between the razor parts and the shaver's face, e.g., a polyethylene oxide in the range of molecular weights between 100,000 and 6,000,000; a non-ionic polyacrylamide; and/or a natural polysaccharide derived from plant materials such as "guar gum."

C. An agent which modifies the chemical structure of the hair to allow the razor blade to pass through the whiskers very easily, e.g., a depilatory agent is one example.

D. A cleaning agent which allows the whisker and skin debris to be washed more easily from the razor parts during shaving, e.g., a silicon polyethylene oxide block copolymer and detergent such as sodium lauryl sulfate.

E. A medicinal agent for killing bacteria, or repairing skin damage and abrasions.

F. A cosmetic agent for softening, smoothing, conditioning or improving the skin.

G. A blood coagulant for the suppression of bleeding that occurs from nicks and cuts.

H. An astringent for constricting blood vessels thereby stemming the flow of bodily fluids such as lymph, which may exude from skin which has been irritated during shaving.

Alternatively, the shaving aid may be one or a combination of the shaving aids disclosed in U.S. Pat. No. 5,056,221 to Thoene, U.S. Pat. No. 4,044,120 to Rowsell et al., U.S. Pat. No. 5,095,619 to Davis et al., all of which are hereby incorporated by reference.

The guard 42 is operable to pre-stretch the surface being shaved in preparation for the engagement of the hairs by the razor blade 16. The guard 42, which may be integral with the bridge 20 or separately formed and attached thereto, can be made of any suitable material including, but not limited to, elastomeric materials, and may further include protrusions, depressions, and/or ridges that aid in the stretching of the skin. A theoretical plane extending tangentially from the uppermost portion of the guard 42 to the uppermost portion of the cap 18 is defined as the shave plane.

Figure 2:
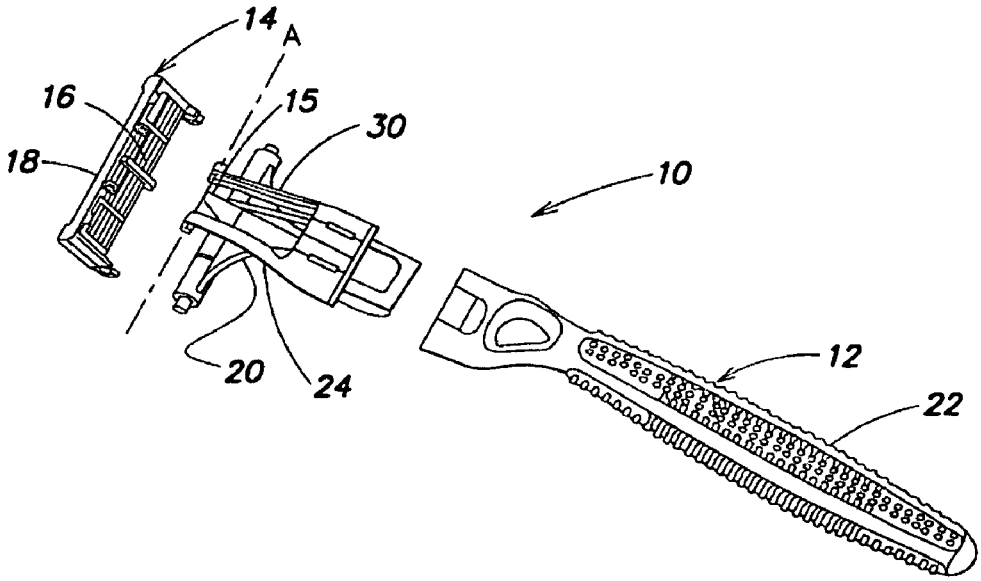
FIG. 2 is an exploded perspective view of the back of the shaving implement of the present invention.

Referring to FIG. 2, the handle 12 may be defined by a lower grip portion 22 and a removable upper portion 24 or supporting portion at which the razor cartridge 14 is attached to define a razor head. The razor cartridge 14 is attached to support arms 30 protruding from the upper portion 24. The points of attachment of the razor cartridge 14 to the support arms 30 define a pivot axis A about which the razor cartridge pivots. The pivot axis A is positioned in the area of the cap 18 and below the razor blade 16. The bridge 20 connects the upper portion 24 of the handle 12 and the underside of the razor cartridge 14. A biasing member 15 also extends from the upper portion 24 to engage the underside of the razor cartridge 14.

Figure 3:
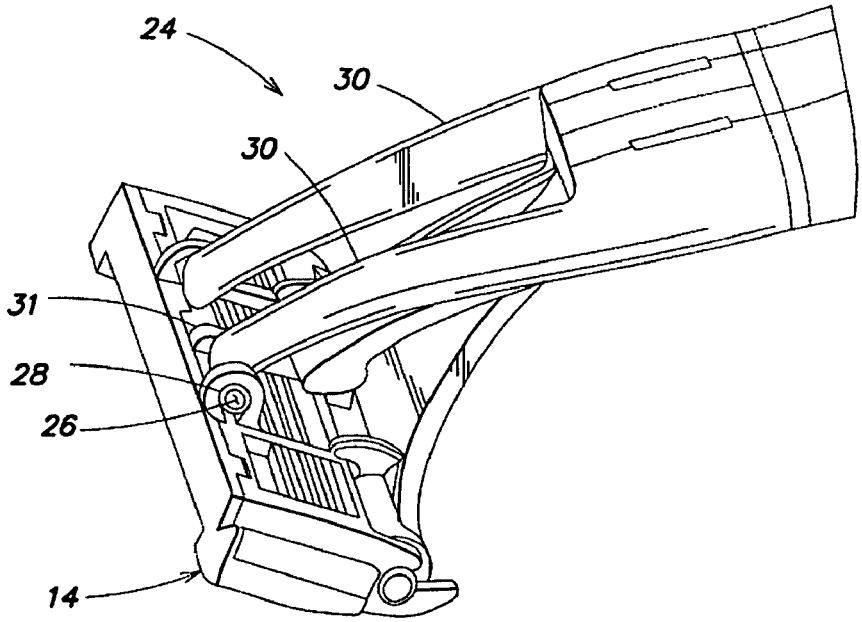
FIG. 3 is a back perspective view of the shaving implement of the present invention.

Referring to FIG. 3, each support arm 30 protrudes from the upper portion 24 of the handle and is pivotally connected to the razor cartridge 14. Each support arm 30 includes a pivot pin 26 that is received in an aperture in a protruding surface 28 on the underside of the razor cartridge 14. Flexible tabs 31 may be positioned proximate the protruding surfaces 28 to facilitate the retention of the pivot pins 26 in the apertures. The present invention is not limited in this regard, however, and the pivot pins may be retained on the razor cartridge using flexible clips or the like, or pins extending from the razor cartridge may be received in apertures located in the surfaces of the support arms. In any embodiment, the pivot pins and their respective attachments to the razor cartridge 14 are located so as not to interfere with the rinsing of debris through the razor cartridge. Preferably, two support arms 30 extend from the upper portion 24 of the handle to independently mount the razor cartridge 14. The use of two support arms 30 flexibly attached to the upper portion 24 of the handle allows the razor cartridge 14 to move efficiently over contours in the skin surface being shaved.

Figure 4:
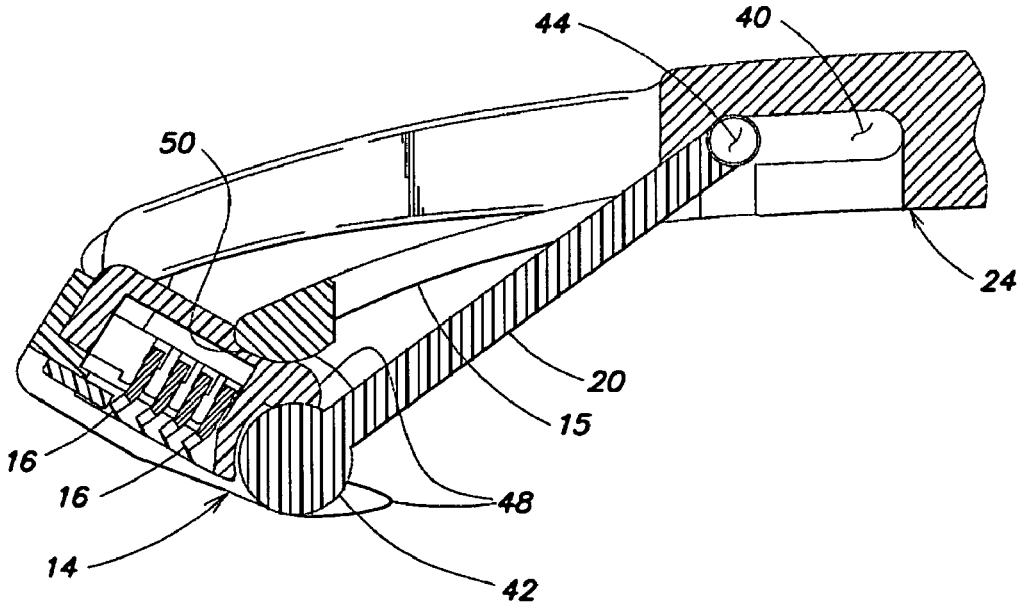
FIG. 4 is a side sectional view of the shaving implement of the present invention, showing a sliding connection of a bridge to an upper portion of a handle.

Referring to FIG. 4, the bridge 20 is slidably connected to the upper portion 24 of the handle and pivotally connected to the underside of the razor cartridge 14 via the guard 42. In the embodiment depicted, the bridge 20 has a first end positioned in a channel 40 formed, cut, or otherwise disposed in the upper portion 24. The channel 40 includes a first end and a second end. The first end of the bridge 20 includes a laterally extending pin 44 that is received in the channel 40. When the bridge 20 is mounted in the channel 40, the first end of the bridge can slide along a length of the channel. In an unbiased and neutral position, the pin 44 rests in the channel 40 intermediate the ends of the channel, thereby allowing the razor cartridge 14 to pivot bidirectionally into the rotated positions. The present invention is not limited in this regard, however, and in an unbiased and neutral position the pin 44 may rest at either the first or second end of the channel 40. The length of the bridge 20 is selected to define the amount of pivot of the razor cartridge 14.

A second end of the bridge 20 terminates in the guard 42, which approximates an axle, and the ends of which are received in bridge connecting members 48 positioned at a forward portion of the razor cartridge 14. Each bridge connecting member 48 is defined by a slot, the defining boundary of which is rounded to complementarily accommodate at least the ends of the guard 42 when the razor cartridge 14 is mounted on the bridge 20. The present invention is not limited with regard to a pivotal guard held in a slot on the razor cartridge, as the razor cartridge may include an integrally formed guard having pins or similar structure that may be complementarily mounted in clips or clamps or other receiving structure on the bridge. The present invention is also not limited with regard to a pivotal guard retained in clips or clamps or other receiving structure on the razor cartridge, as other types of connections (e.g., a stationary guard connected to the bridge via a living hinge) are within the scope of the present invention. Also, although the bridge connecting members 48 are depicted as being located forward of all of the razor blades 16, the present invention is not limited in this regard and the bridge connecting members can be located elsewhere on the razor cartridge. The bridge 20 may be substantially rigid, or it may be flexible.

The biasing member 15 extends from the upper portion 24 adjacent the surface at which the channel 40 is positioned. A forward end of the biasing member 15 has a curved surface 50 that engages the underside of the razor cartridge 14. The biasing member 15 is flexible such that when the curved surface 50 engages the underside of the razor cartridge 14, the biasing member urges the razor cartridge from a rotated position to a neutral position. In biasing the razor cartridge back to the neutral position, the pin 44 slides back to its original unbiased position in the channel 40.

Figure 5:
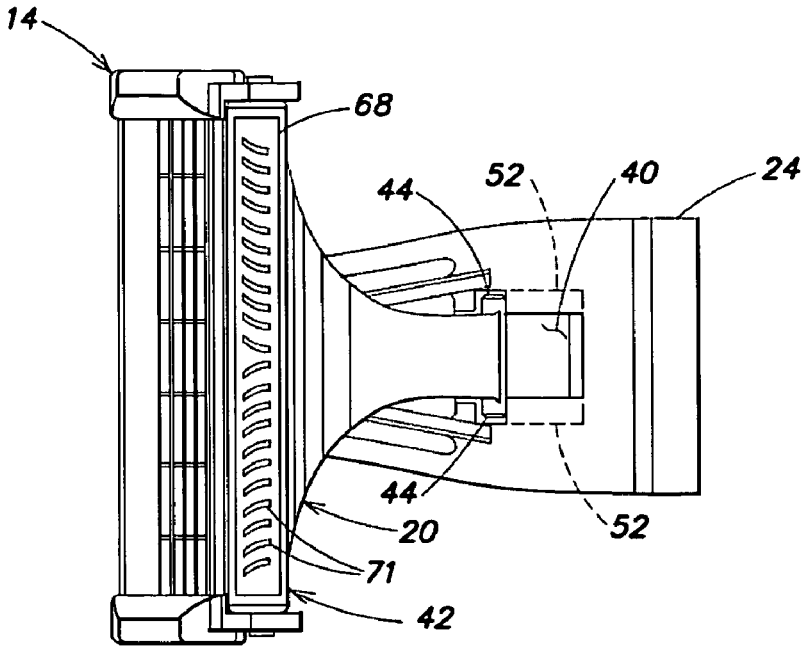
FIG. 5 is a front view of the shaving implement of FIG. 4.
Figure 6:
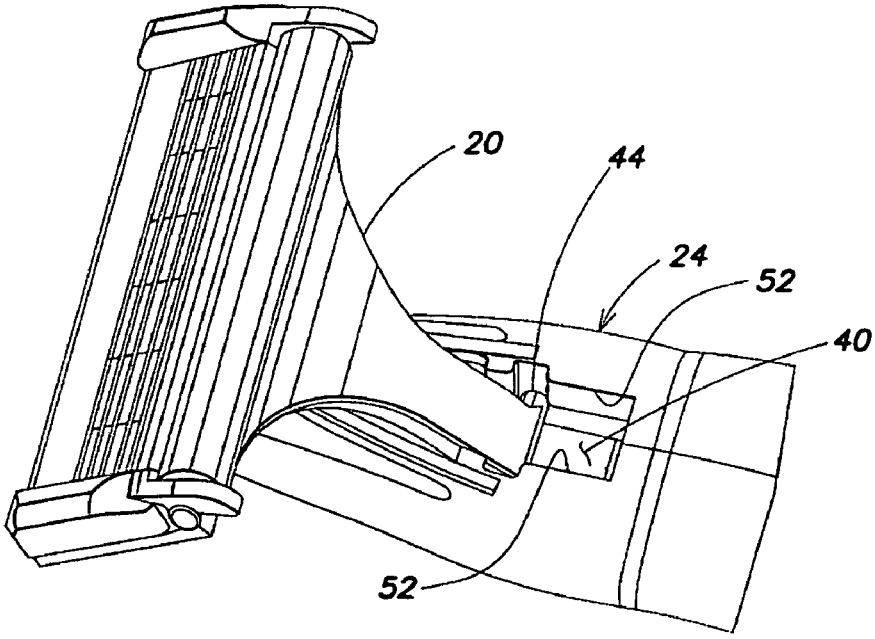
FIG. 6 is a front perspective view of the shaving implement of FIG. 4.

As is shown in FIGS. 5 and 6, the channel 40 is defined by an open slot in the upper portion 24 of the handle having an overhanging portion 52 that extends at least partially around the periphery of the slot. When the first end of the bridge 20 is received in the channel 40, the laterally extending ends of the pin 44 are captured and retained in the channel by the overhanging portion 52.

Referring specifically to FIG. 5, the bridge 20 can include a skin stretching member 68 disposed on the guard 42. The skin stretching member 68 extends across the guard 42 generally parallel to and forward of the razor blade 16 and can be made of any suitable material, such as, but not limited to, an elastomeric material. Protrusions, depressions, and/or ridges may be formed or otherwise disposed on the surface of the skin stretching member to facilitate the stretching of the skin and/or to sweep shaving aid material, water, or debris out of the path of the razor blades. Protrusions in the form of ridges are designated by the reference numeral 71. Preferably, the surface of the skin stretching member 68 follows the curve of the guard 42 such that when the razor cartridge 14 is biased and the bridge 20 moves, the skin stretching member remains in contact with the surface being shaved.

Figure 7:
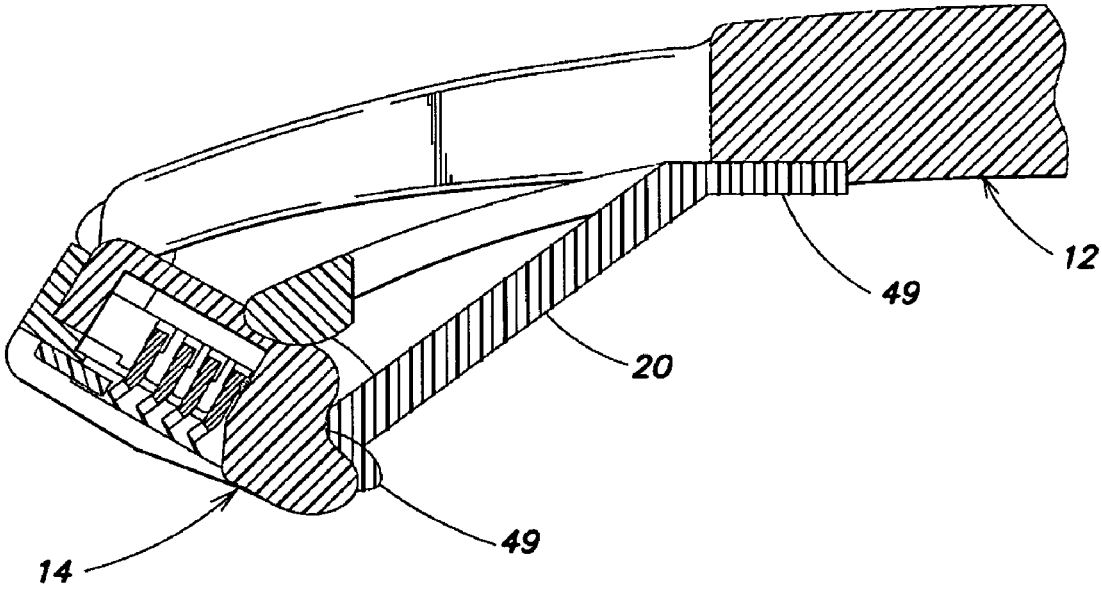
FIG. 7 is a side sectional view of a shaving implement of the present invention, showing a flexible connection of a bridge to an upper portion of a handle.

The present invention is not limited with regard to an elongated member slidably positioned and in a channel in the handle. Referring to FIG. 7, the bridge 20 may be flexible and fixed on either or both the handle 12 and the razor cartridge 14. In such an embodiment, the connection of the bridge 20 to either or both the handle 12 and the razor cartridge 14 may be via living hinges 49.

Figure 8:
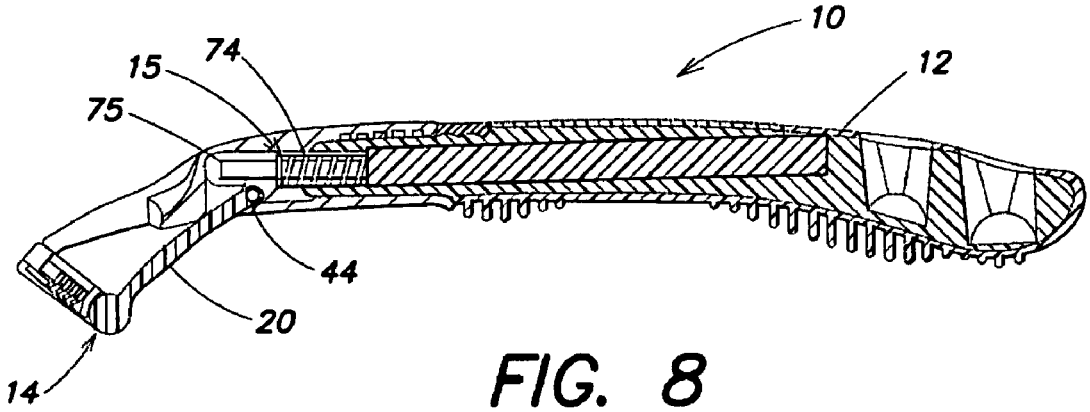
FIG. 8 is a side sectional view of a shaving implement of the present invention, wherein a biasing member is a compression spring located in a handle, and wherein a razor cartridge is in a neutral position.
Figure 9:
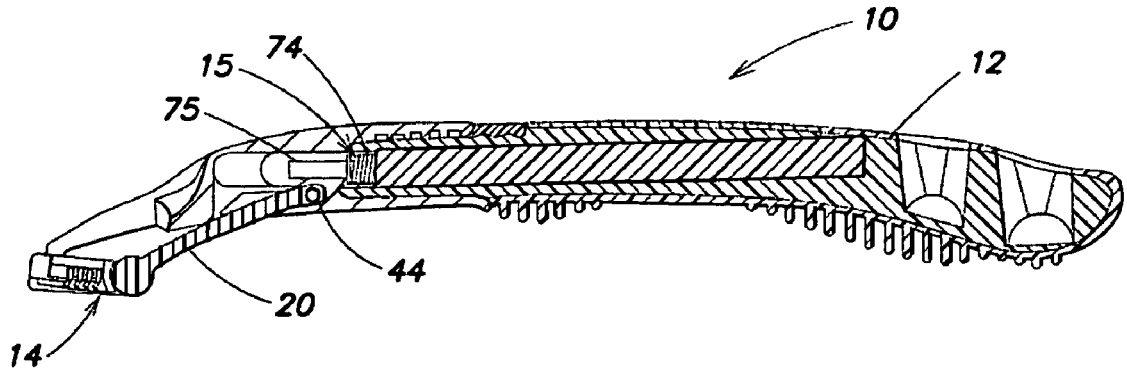
FIG. 9 is a side sectional view of the shaving implement of FIG. 8, wherein the razor cartridge is in a rotated position.

Referring now to FIGS. 8 and 9, the biasing member 15 may be located in the handle 12 or structure supporting the biasing member. In such embodiments, the biasing member 15 can be a compression spring 74 and an adjacently-located plunger 75. The second end of the bridge 20 (the pin 44) cooperates with the plunger 75. During periods of non-use of the shaving implement 10 (FIG. 8), the compression spring 74 urges the plunger 75 and the razor cartridge 14 into the neutral (non-pivoted) position. When the shaving implement 10 is used (FIG. 9), the razor cartridge 14 is moved into the pivoted position, thus urging the plunger 75 against the compression spring 74 and causing it to compress.

Referring now to all the Figures, during a typical shaving operation the razor cartridge 14 is biased from the neutral position to at least a partially rotated position. As the razor cartridge 14 encounters an elevation in the skin surface, pivotal movement of the razor cartridge 14 about the pivot axis A is absorbed by the flexibility of the biasing member 15 (or causes the plunger 75 to compress the compression spring 74) and either the first end of the bridge 20 translates along the length of the channel 40 (FIGS. 5 and 6) or the bridge itself flexes (FIG. 7). Thus, the razor cartridge 14 is further rotated about the pivot axis A. After encountering the elevation in the skin surface, the razor cartridge 14 is released from the rotated position and is urged back to the partially rotated position. When, during use, the razor cartridge 14 encounters a depression in the skin surface, the razor cartridge is rotated about the pivot axis A from the partially rotated position in the direction of the neutral position. When there are no forces exerted on the razor cartridge 14 (e.g., during periods of non-use, when the shaving implement 10 is lifted from the skin surface between shaving strokes), the biasing member 15 returns the razor cartridge to the neutral position.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. A shaving implement, comprising;

a handle;

a razor cartridge, comprising, at least one razor blade, and a cap located aft of the at least one razor blade, the razor cartridge being pivotally connected to the handle such that the razor cartridge pivots about an axis that is generally parallel to and aft of the at least one razor blade, the razor cartridge being pivotable between a neutral position and a rotated position;

a biasing member extending from the handle and contacting the razor cartridge to urge the razor cartridge toward the neutral position; and a bridge pivotally connected to the razor cartridge forward of the axis about which the razor cartridge pivots and slidably connected to the handle;

wherein the bridge is slidable between a first position when the razor cartridge is in the neutral position and a second position when the cartridge is in the rotated position.

2. The shaving implement of claim 1 wherein the axis about which the cartridge pivots is aft of the at least one razor blade.

3. The shaving implement of claim 1 wherein the biasing member is a cantilevered protrusion extending from the handle and is deflected by the razor cartridge when the razor cartridge pivots from the neutral position toward the rotated position.

4. The shaving implement of claim 1 wherein a portion of the bridge pivotally connected to the razor cartridge forms a guard by extending across the razor cartridge parallel to, and forward of, the at least one razor blade.

5. The shaving implement of claim 4 wherein the bridge includes a skin-stretching member associated therewith, the skin-stretching member being operable to stretch the surface being shaved prior to the at least one razor blade encountering hair to be shaved.

6. The shaving implement of claim 5 wherein the skin-stretching member has a curved surface.

7. The shaving implement of claim 5 wherein the skin-stretching member includes at least one protrusion.

8. The shaving implement of claim 1 wherein the handle includes a channel having a first end and a second end disposed in the handle, and the bridge includes a first end that is located in the channel.

9. The shaving implement of claim 8 wherein the neutral razor cartridge is in the position when the first end of the bridge is in contact with the first end of the channel.

10. The shaving implement of claim 8 wherein the razor cartridge is in the fully rotated position when the first end of the bridge is in contact with the second end of the channel.

11. The shaving implement of claim 8 wherein the razor cartridge is in the neutral position when the first end of the bridge is intermediate the first end and the second end of the channel.

12. The shaving implement of claim 1 wherein the cap has a forward end and an rear end, and wherein the axis about which the razor cartridge pivots relative to the handle is located between the forward end and the rear end of the cap.

13. The shaving implement of claim 1 wherein the razor cartridge defines a shave plane and wherein the axis about which the razor cartridge pivots relative to the handle is located below the shave plane.

14. The shaving implement of claim 1 wherein the bridge is substantially rigid.

15. The shaving implement of claim 1 wherein the razor cartridge is pivotally connected to the handle via a support arm extending from an upper portion of the handle.

16. The shaving implement of claim 15, wherein the support arm is flexible attached to the upper portion of the handle.

* * * * *